United States Patent [19]

Abe et al.

[11] 4,257,369

[45] Mar. 24, 1981

[54] INTERNAL COMBUSTION ENGINE EQUIPPED WITH NOISE CONTROL DEVICE

[75] Inventors: Eiichi Abe; Naoki Ogawa; Takao Kubozuka, all of Yokohama; Hirofumi Takei, Yokosuka, all of Japan

[73] Assignee: Nissan Motor Company, Limited, Yokohama, Japan

[21] Appl. No.: 938,659

[22] Filed: Aug. 31, 1978

[30] Foreign Application Priority Data

Sep. 6, 1977 [JP] Japan ..... 52-106301

[51] Int. Cl.³ ..... F02B 77/00

[52] U.S. Cl. ..... 123/198 E; 123/195 C; 123/195 S

[58] Field of Search ..... 123/198 E, 195 C, 195 S; 181/204

[56] References Cited

U.S. PATENT DOCUMENTS

| | | | |
|---|---|---|---|
| 3,684,053 | 8/1972 | Fachbach et al. | 123/198 E |
| 3,693,602 | 9/1972 | Thien et al. | 123/195 C |
| 3,796,280 | 3/1974 | Thien et al. | 123/198 E |
| 3,991,735 | 11/1976 | Horstmann | 123/195 C |
| 4,071,008 | 1/1978 | Skatsche et al. | 123/195 C |
| 4,077,383 | 3/1978 | Hatz | 123/195 C |

*Primary Examiner*—Ira S. Lazarus

*Attorney, Agent, or Firm*—Schwartz, Jeffery, Schwaab, Mack, Blumenthal & Koch

[57] ABSTRACT

An engine of a motor vehicle is equipped with a sound-insulating cover which is secured to a portion of an engine proper to surround the engine proper. An oil pan filled with engine oil is hermetically connected to the bottom portion of the sound-insulating cover so that the oil pan is spaced apart from the skirt portion of a crankcase.

10 Claims, 10 Drawing Figures

INTERNAL COMBUSTION ENGINE EQUIPPED WITH NOISE CONTROL DEVICE

BACKGROUND OF THE INVENTION

This invention relates to an internal combustion engine of a motor vehicle, equipped with a device for decreasing noise from the engine.

The origin of all important vehicle noises can be attributed to the production and application of the propulsive power or to the forward passage of the vehicle itself. As is known, the noise radiated from engines is a predominant source of noise. The engine noise is broadly classified into two kinds one of which is caused by the fact that the combustion noise generated in combustion chambers of the engine and mechanical noise generated in the rocker room pass through and are radiated out of the engine proper and the rocker cover of the engine. The other is caused by the fact that the combustion noise, due to crankshaft bearings, are conducted through the engine proper. Of these noises, the latter is converted into high frequency vibrations having frequencies of 1 KHz to 4 KHz while the noises are transmitted through a complicate engine structure, and thereafter the high frequence vibrations are radiated through the skirt portion of the crankcase, magnifying the vibrations since the skirt portion of the crankcase serves as a loudspeaker. Simultaneously, the high frequency vibrations cause the oil pan to vibrate and accordingly the oil pan becomes a new predominant noise source.

These noises radiated from the engine can be suppressed to a considerable extent by a sound-insulating cover for covering all or a part of the engine. However, this is not sufficient for the purpose of controlling engine noises. Because, the sound-insulating cover itself may considerably be vibrated due to the relationship between the natural frequency of and the vibration applied to the sound-insulating cover. Therefore, it is impossible to expect a great sound-insulating effect to such a sound-insulating cover.

SUMMARY OF THE INVENTION

It is the prime object of the present invention to provide an improved internal combustion engine for motor vehicles, with which noises from the engine can be decreased to a considerable extent.

Another object of the present invention is to provide an improved automotive internal combustion engine equipped with a sound-insulating cover surrounding the engine, in which the vibrations of a cylinder block is not directly conducted to an oil pan disposed at lower portion of the engine, and the sound-insulating cover is not liable to vibrate.

A further object of the present invention is to provide an improved automotive internal combustion engine equipped with a sound-insulating cover surrounding the engine, in which an oil pan is not directly connected to the skirt portion of a crankcase to prevent the oil pan to vibrate, and the oil pan filled with engine oil is connected to a lower portion of the sound-insulating cover so that the sound-insulating cover increases in weight or mass to prevent itself from vibrating due to its resonance effect.

Other objects, features and advantages of the internal combustion engine according to the present invention will be more apparent from the following description taken in conjunction with the accompanying drawings in which like reference numerals designate like parts and elements throughout all embodiments.

DESCRIPTION OF THE PREFERRED EMBODIMENTS

Figure 1:
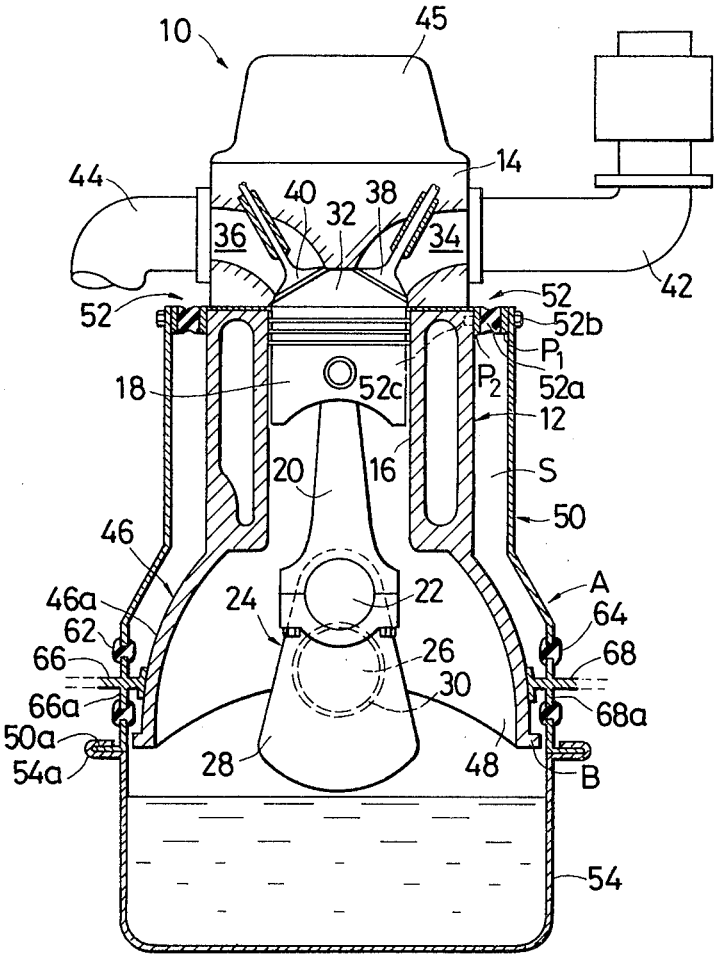
FIG. 1 is a longitudinal view of a preferred embodiment of an engine in accordance with the present invention.
Figure 2:
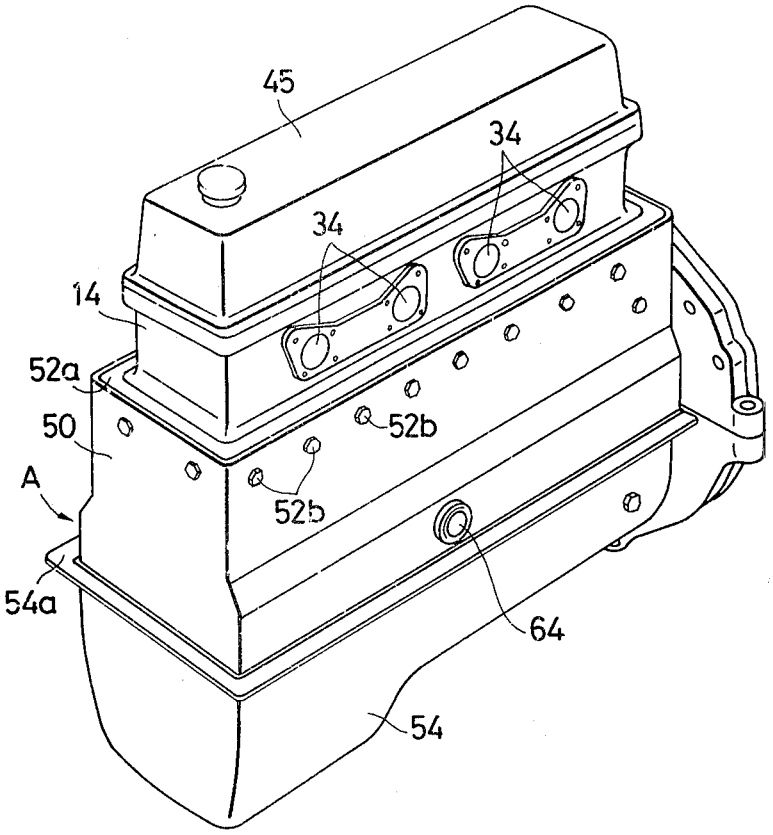
FIG. 2 is a perspective view of a sound-insulating cover used in the engine of FIG. 1.

Referring now to FIGS. 1 to 4 of the drawing, a preferred embodiment of an internal combustion engine according to the present invention is shown including an engine proper or an engine block 10 mounted on a vehicle body of a motor vehicle or an automobile (not shown). The engine proper 10, as customary, is composed of a cylinder block 12 and a cylinder head 14 secured to the top portion of the cylinder block 12. The cylinder block 12 is formed with cylinders one 16 of which is shown in FIG. 1. A piston 18 is reciprocally movably disposed in each cylinder 16. The piston 18 is connected through a connecting rod 20 to a crankpin 22 of a crankshaft 24. Denoted by the reference numerals 26 and 28 are a crankshaft journal and a crankshaft counterweight, respectively. The crankshaft journal 26 is, as usual, rotatably mounted through a main bearing 30 on the cylinder block 12.

The cylinder head 14 is formed with a concavity (no numeral) which defines a combustion chamber 32 in cooperation with the piston crown of the piston 18. The combustion chamber 32 is communicable with an intake port 34 and an exhaust port 36 through an intake valve 38 and an exhaust valve 40, respectively. The intake and exhaust ports 34 and 36 communicate with an intake manifold 42 and an exhaust manifold 44, respectively. The reference numeral 45 represents a rocker cover secured to the top portion of the cylinder head 14.

The cylinder block 12 is provided with a crankcase 46 which surrounds the movable crankshaft 24, but opens at its bottom portion defining an opening 48. It is to be noted that the bottom-most portion B of the skirt portion 46*a* of the crankcase 46 is thicker than other portions to prevent the bottom-most portion to vibrate.

Figure 3:
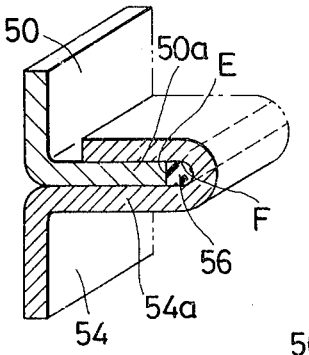
FIG. 3 is a perspective view of a connected portion of the sound-insulating cover and an oil pan, showing the cross-section thereof.
Figure 4:
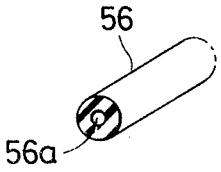
FIG. 4 is a perspective view of a seal member used at the connected portion of FIG. 3, showing the cross-section thereof.

A sound-insulating cover 50 is secured to the side surface of an upper portion of the cylinder block 12 which portion is in close proximity to the cylinder head 14, by means of securing devices 52. An oil pan 54 filled with an engine oil (no numeral) is hermetically connected to the bottom-most portion of the sound-insulating cover 50 to form an engine cover A by making a flange portion 54*a* of the pan 54 bend over a bottom portion 50*a* of the sound-insulating cover 50. This connected portion is shown in detail in FIG. 3. In FIG. 3, the reference numeral 56 represents a seal member disposed in a space defined by an edge E of the flange portion 50*a* of the sound-insulating cover 50 and the inner surface F of the flange portion 50*a* of the oil pan 54. The seal member 56 functions to provide a hermetical seal between the inside and outside of the connected oil pan and sound-insulating cover in order to prevent the engine oil and gases in the oil pan 54 to leak out of the oil pan 54. The seal member 56 is made of one of a rubber, a liquid etc. FIG. 4 illustrates an example of the seal member 56 made of rubber, which has a wire 56*a* at the central portion thereof to increase the tensile strength of the seal member 56.

The sound-insulating cover 50 is located in spaced relation and around the outer surface of the cylinder block 12 to define a sound-insulating space S between the inner surface of the sound-insulating cover 50 and the outer surface of the cylinder block 12. Each securing device 52 includes an elastic or elastomeric member 52*a* which is disposed between the cylinder block 12 and the sound-insulating cover 50. Two plate members $P_1$ and $P_2$ are fixed to the both sides of the elastic member 52*a*. A bolt 52*b* functions to secure the sound-i-sulating cover 50 to the plate member $P_1$. The other plate member $P_2$ is secured to the cylinder block 12 by a threaded member 52*c* fixed to the plate member $P_2$. The elastic member 52*a* provides gas-tight and liquid-tight seals between the inside and outside of the engine cover A to prevent the engine oil and so-called blow-by gas in the engine from leaking outside the sound-insulating cover 50 through the sound-insulating space S and to prevent water and dusts outside the engine from entering inside the sound-insulating cover through the same. Furthermore, the elastic member 52*a* is formed of a material of a relatively low spring constant to prevent the vibration of the cylinder block 12 from being conducted to the sound-insulating cover 50.

While the sound-insulating cover 50 has been shown to be secured to an upper portion of the cylinder block 12 with the securing device 52, it will be understood that the cover 50 may be secured to other portion of the cylinder block 12 with other device. Moreover, the engine cover A including the sound-insulating cover 50 and the oil pan 54 may be supported on a vehicle body (not shown).

The sound-insulating cover 50 is formed with two circular openings 58 and 60 which are located at the lower portion thereof and opposite to each other. Two annular elastic or elastomeric members 62 and 64 are disposed in the openings 58 and 60, respectively. Each annular elastic memver is formed at its outer peripheral surface with an outer annular groove (no numeral) in which the sound-insulating cover 50 is disposed. The each annular elastic member is further formed at its inner peripheral surface with an inner annular groove (no numeral). A disc portion 66*a* of a supporting member 66 is disposed in the inner annular groove of the annular elastic member 62, and similarly a disc portion 68*a* of a supporting member 68 is disposed in the inner annular groove of the annular elastic member 64. The supporting members 66 and 68 are secured to the opposite outer surfaces of the skirt portion 46*a* of the crankcase 46, respectively, and securely connected to the vehicle body in order to mount the engine block 10 on the vehicle body.

With the thus arranged engine, the engine cover A increases in weight or mass by an amount corresponding to the oil pan 54 and the engine oil filled therein, as compared with in a case where only sound-insulating cover without an oil pan is used. It is to be noted that the natural frequency of a vibration system is approximately inversely as the square root of its mass. Therefore, the natural frequency of the engine cover A decrease to a considerably extent as compared with in the case using only the sound-insulating cover. As described above, noises of considerably high frequency vibrations are radidated from the skirt portion 46*a* of the engine crankcase 46 and conducted through the securing device 52 to the sound-insulating cover 50. It will be understood from the foregoing, that the natural frequency of and the frequency of vibration applied to the engine cover A are considerably different and far from each other, and consequently the resonance of the engine cover A can not be occurred by the vibration applied thereto. Hence, the noises from the engine proper 10 is effectively insulated by the engine cover A including the sound-insulating cover 50 connected to the oil pan 54.

Additionally, when the vibration of the engine cover A is applied to the engine oil in the oil pan 54, this vibration is damped by virtue of the viscous resistance of the engine oil. This also prevents the engine cover A from vibrating. Furthermore, since the volume of the space in the engine increases by the space S defined between the outer surface of the cylinder block 12 and the inner surface of the sound-insulating cover 50, the natural frequency of the space in the engine is considerably lowered and accordingly the space is prevented from its resonance.

Figure 5:
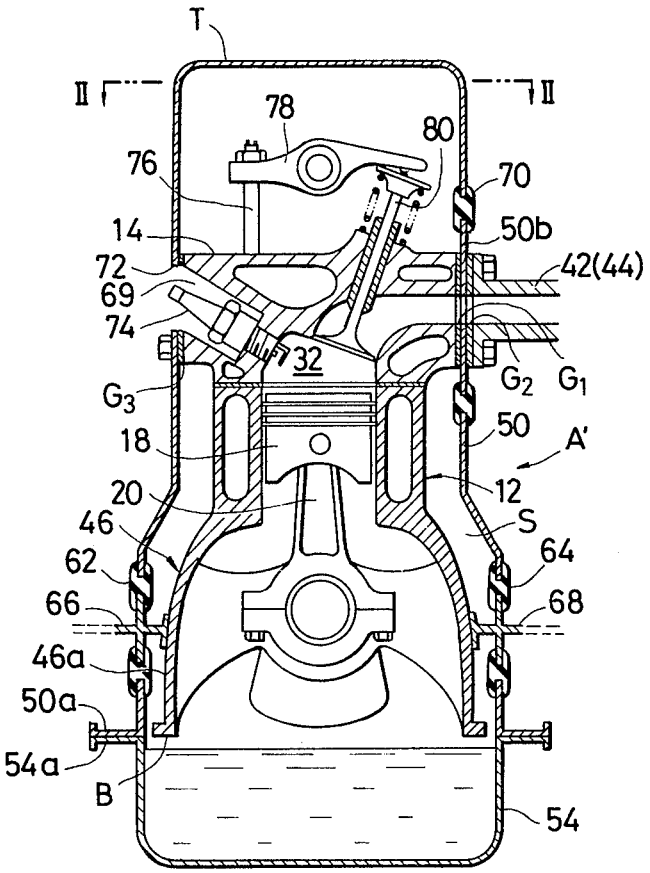
FIG. 5 is a longitudinal sectional view of another preferred embodiment of an engine in accordance with the present invention.
Figure 6:
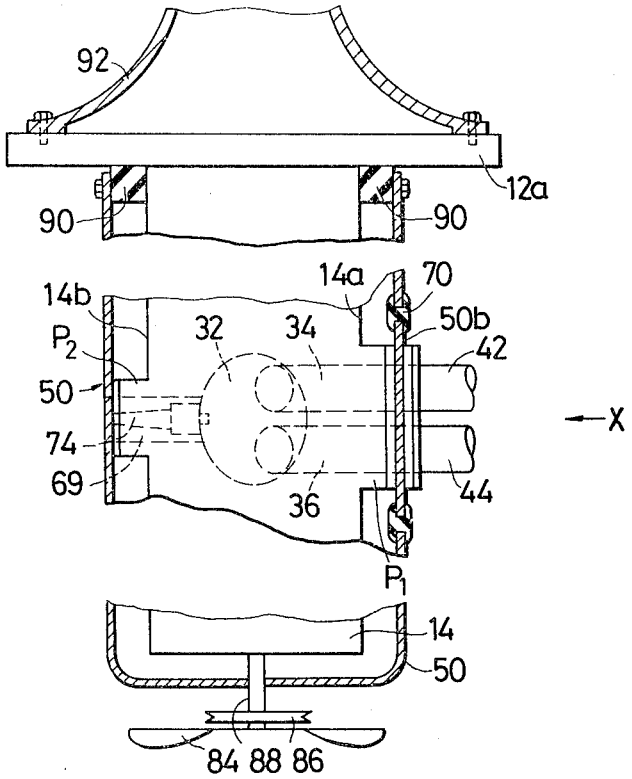
FIG. 6 is a transverse sectional view taken along the line II—II in FIG. 5.

FIGS. 5 and 6 illustrate another preferred embodiment of the engine according to the present invention, which is similar to the embodiment of FIG. 1 with the exception that the sound-insulating cover 50 includes an engine top cover portion T serving as a rocker cover. The top cover portion T is integrally formed with a bottom cover portion B forming part of the engine cover A'.

As clearly seen from FIG. 6, the cylinder head is provided with protruded portions $P_1$ and $P_2$ which are partially protruded from the levels of the side surfaces 14*a* and 14*b* of the cylinder head 14, respectively. The protruded portion $P_1$ is formed therein with the intake and exhaust ports 34 and 36. The protruded portion $P_2$ is formed therein with an opening 69. In this embodiment, a portion 50*b* of the sound-insulating cover 50 is inserted between the protruded portion $P_1$ and at least one of intake and exhaust manifolds 42 and 44 through a gasket $G_1$ disposed between the cylinder head side surface 14*a* and the portion 50*a* of the sound-insulating cover 50 and another gasket $G_2$ disposed between the portion 50*b* of the sound-insulating cover 50 and the flat surface of the manifold 42(44). The portion 50*b* is secured to the flat surface of the protruded portion $P_1$ by bolts (no numerals) together with the manifold 42(44).

Figure 7:
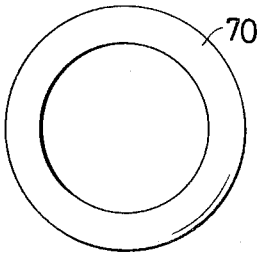
FIG. 7 is a view of an annular elastic member viewed from the direction of an arrow X of FIG. 6.

It is to be noted that the portion 50*b* is essentially separate from the other portion of the sound-insulating cover 50, but connected to the same through an annular elastic member 70 or insulating rubber in order to prevent vibration of the engine block from being conducted to the sound-insulating cover 50. FIG. 7 shows the elastic member 70 as viewed from the direction of an arrow X of FIG. 6. The annular elastic member 70 is disposed in an opening (no numeral) formed through the wall of the sound-insulating cover 50. Furthermore, the annular elastic member 70 is formed at its inner peripheral surface with an inner annular groove (no numeral) in which the portion 50*b* of the sound-insulating cover 50 is disposed, and at its outer peripheral surface with an outer annular groove (no numeral) in which the other portion of the sound-insulating cover 50 is disposed.

The sound-insulating cover 50 is also secured to the flat surface of the protruded portion $P_2$ through a gasket $G_3$ by means of bolts (no numerals). In this embodiment, the sound-insulating cover 50 is formed with an opening 72 through which a spark plug 74 is installed to mount on the engine so that the electrodes thereof project into the combustion chamber 32. The reference numerals 76, 78 and 80 denote a push-rod, a rocker arm and a valve stem, respectively. In this embodiment, the oil pan 54 is hermetically connected to the bottom portion of the sound-insulating cover 50 by securing the flange portion 54*a* of the oil pan 54 to the flange portion 50*a* of the sound-insulating cover 50, for example, with bolts (not shown).

Figure 8:
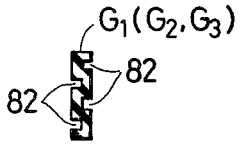
FIG. 8 is a cross-sectional view of one of gaskets used in the engine of FIG. 5.
Figure 9:
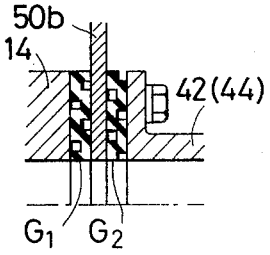
FIG. 9 is a cross-sectional view showing a used state of the gaskets of the type shown in FIG. 8.

In order to prevent the vibration of the engine block 10 from being conducted to the sound-insulating cover 50, it is preferable to decrease the surface areas of the gaskets $G_1$, $G_2$ and $G_3$ themselves, or to form each gasket into the shape in cross-section shown in FIG. 8 in which the gasket is formed with a plurality of grooves 82 on its both flat surfaces which are urgingly contacted other metallic surfaces, respectively. In this connection, FIG. 9 shows the gaskets $G_1$ and $G_2$ of the shape shown in FIG. 6 and installed in positions shown in FIG. 5. With the thus arranged engine, as clearly shown in FIG. 5, the space in the engine is considerably increased since the inside of the top cover portion T communicates with the inside of the bottom cover portion B through the space S including the space defined between the sound-insulating cover 50 and the cylinder head. Accordingly, the natural frequency of the space S in the engine is considerably lowered to effectively damp high frequency vibrations of noises of crankshaft bearings, mechanical noises in the top cover portion T or the rocker cover, noises due to vibration of the skirt portion 46*a* of the crankcase 46.

Figure 10:
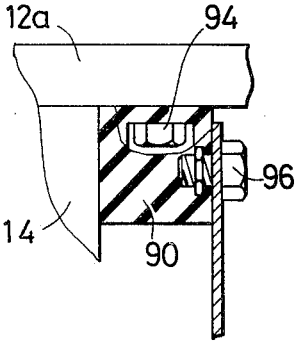
FIG. 10 is an enlarged fragmentary view showing a detailed construction of an elastic member of FIG. 6.

In FIG. 6, the reference numerals 84, 86 and 88 denote a cooling fan, a fan pulley, and a rotatable shaft of a water pump (not shown). As viewed, the sound-insulating cover 50 is secured also to a plate portion 12*a* of the cylinder block 12 (not shown in FIG. 6) through elastic members 90. A transmission case 92 is, as usual, secured to the plate portion 12*a* by bolts (no numerals). Each elastic member 90 is constructed and arranged to connect the sound-insulating cover 50 to the plate portion 12*a* as shown in FIG. 10 in which the elastic member 90 is fixed to the plate portion 12*a* by a bolt 94, and the cover 50 is fixed to the elastic member 90 by a bolt 96.

It will be understood that engine oil in the top cover portion T or the cover can flow down to the oil pan 54 through a part of the space S defined between the cylinder head and the sound-insulating cover 50 as clearly shown in FIG. 6. Consequently, conventionally used oil passages connecting between the inside of a rocker cover and an oil pan can be omitted in the engine as shown in FIGS. 5 and 6. Additionally, in the engine shown in FIGS. 5 and 6, since engine oil present in the top cover portion T or the rocker cover flows down on the outer surface of the cylinder block 12, the outer surface of the cylinder block 12 can be sufficiently cooled down.

It will be appreciated that the vibration of the sound-insulating cover 50 can be prevented to a considerable extent by increasing the stiffness thereof which is achieved, for example, by forming beads on the surface of the sound-insulating cover 50.

While the sound-insulating cover 50 has been shown and described to be formed integrally as one piece, it will be understood that the sound-insulating cover may be made by forming separately a plurality of pieces of the cover and thereafter hermetically connecting to each other.

What is claimed is:

1. An internal combustion engine of a motor vehicle including an engine block provided with a crankcase, and a cylinder head secured to the cylinder block, said engine comprising:

a sound-insulating cover secured to a portion of the engine block which portion is spaced apart from the crankcase, maintaining a hermetical seal between said sound-insulating cover and the engine block, said sound-insulating cover being located in spaced relation to and around the outer surface of the engine block to cover the engine block, said sound-insulating cover being provided with a first flange portion;

an oil pan adapted to be filled with an engine oil, which is hermetically connected to said sound-insulating cover to be spaced apart from the crankcase of the cylinder block, said oil pan being provided with a second flange portion, the second flange portion bending over the first flange portion to provide a secure connection of said oil pan with said sound-insulating cover; and a seal member disposed in a space defined by an edge of the first flange portion and a surface of the second flange portion which bends over the first flange portion.

2. An internal combustion engine of a motor vehicle including an engine block having a cylinder block provided with a crankcase, and a cylinder head secured to the cylinder block, said engine comprising:

a sound-insulating cover secured to an upper portion of the cylinder block which portion is spaced apart from the crankcase, maintaining a hermetical seal between said sound-insulating cover and said cylinder block, said sound-insulating cover being located in spaced relation to and around the outer surface of the cylinder block to cover the cylinder block, said sound-insulating cover being provided with a first flange portion;

an oil pan adapted to be filled with an engine oil, which is hermetically connected to said sound-insulating cover to be spaced from the crankcase of the cylinder block, said hermetical seal between said sound-insulating cover and said cylinder block comprising means for preventing oil vapor from contacting said cylinder head, said oil pan being formed with a second flange portion, the second flange portion bending over the first flange portion to provide a secure connection of said oil pan with said sound-insulating cover; and a seal member disposed in a space defined by an edge of the first flange portion and a surface of the second flange portion which bends over the first flange portion.

3. An internal combustion engine as claimed in claim 1 or 2, in which said sound-insulating cover is secured to the cylinder block in close proximity to the cylinder head.

4. An internal combustion engine as claimed in claim 1 or 2, in which said seal member is a cylindrical elastic member having a wire therein.

5. An internal combustion engine as claimed in claim 1 or 2, further comprising engine supporting means by which the engine block is supported on the body of the vehicle.

6. An internal combustion engine as claimed in claim 3, in which said sound-insulating cover is secured through an elastic member.

7. An internal combustion engine as claimed in claim 5, in which said engine supporting means includes first and second engine supporting members which are secured opposite to first and second side outer surfaces of the crankcase of the cylinder block and mounted on two portions of the vehicle body, respectively, passing through the wall of said sound-insulating cover.

8. An internal combustion engine as claimed in claim 7, said sound-insulating cover is formed with first and second openings which are located opposite to each other and face to the first and second side outer surfaces of the crankcase, the first and second engine supporting members passing through the first and second openings.

9. An internal combustion engine as claimed in claim 8, further comprising first and second annular elastic members which are disposed in the first and second openings, respectively, in a manner that the inner and outer peripheral surfaces of said first annular elastic member hermetically contact the first engine supporting member and the periphery of the first opening of the sound-insulating cover, respectively, and the inner and outer peripheral surface of said second annular seal member hermetically contact the second engine supporting member and the periphery of the second opening of said sound-insulating cover, respectively.

10. An internal combustion engine as claimed in claim 9, in which each annular elastic member is formed on its outer peripheral surface with an outer groove in which a portion of said sound-insulating cover is disposed, and on its inner peripheral surface with an inner groove in which a portion of the engine supporting member is disposed.

* * * * *